US012546133B2

(12) United States Patent
De Rycke et al.

(10) Patent No.: US 12,546,133 B2
(45) Date of Patent: Feb. 10, 2026

(54) TERRACE CANOPY

(71) Applicant: Renson Outdoor NV, Waregem (BE)

(72) Inventors: Thomas De Rycke, Ghent (BE); Kristof Lemiegre, Gentbrugge (BE); Pieter Brabant, Rumbeke (BE); Lennart De Meulemeester, Ledeberg (BE)

(73) Assignee: Renson Outdoor NV, Kruisem (BE)

( * ) Notice: Subject to any disclaimer, the term of this patent is extended or adjusted under 35 U.S.C. 154(b) by 200 days.

(21) Appl. No.: 18/567,538

(22) PCT Filed: Jun. 1, 2022

(86) PCT No.: PCT/IB2022/055103
§ 371 (c)(1),
(2) Date: Dec. 6, 2023

(87) PCT Pub. No.: WO2022/259088
PCT Pub. Date: Dec. 15, 2022

(65) Prior Publication Data

US 2024/0141670 A1 May 2, 2024

(30) Foreign Application Priority Data

Jun. 10, 2021 (BE) ..... 2021/5460

(51) Int. Cl.
*E04H 6/02* (2006.01)
*E04B 1/24* (2006.01)
(Continued)

(52) U.S. Cl.
CPC ..... *E04H 6/025* (2013.01); *E04B 1/2403* (2013.01); *E04B 7/14* (2013.01); *E04C 3/07* (2013.01);
(Continued)

(58) Field of Classification Search
CPC ..... E04B 1/2403; E04B 7/14; E04B 7/163; E04C 3/07; E04C 2003/0413;
(Continued)

(56) References Cited

U.S. PATENT DOCUMENTS 4,610,561 A * 9/1986 Cecchellero ..... F16B 7/185 403/171
7,883,288 B2 * 2/2011 Jorna ..... F16B 7/0453 403/171
(Continued)

FOREIGN PATENT DOCUMENTS

BE 1021793 B1 1/2016
BE 1028223 A1 11/2021
(Continued)

OTHER PUBLICATIONS

International Search Report and Written Opinion for PCT Application No. PCT/IB2022/055103, dated Jul. 27, 2022, 8 pages.

*Primary Examiner* — Jessie T Fonseca
(74) *Attorney, Agent, or Firm* — Dickinson Wright PLLC

(57) ABSTRACT

The disclosure provides a terrace canopy comprising a support pillar extending in a substantially vertical direction; a first and a second beam each extending in a substantially horizontal direction, wherein each beam is provided with a headboard at at least one end; and a corner element positioned between and secured to the support pillar and the beams and provided with a first and a second wall portion. The headboard of the first beam is attached against the first wall portion of the corner element, and the headboard of the second beam is attached against the second wall portion of the corner element. Mutually cooperating alignment means comprising a tongue and groove are provided between each wall portion and the headboard attached thereto, the mutu-
(Continued)

ally cooperating alignment means being configured for aligning a beam with respect to the support pillar.

17 Claims, 14 Drawing Sheets

(51) Int. Cl.

| | |
|---|---|
| ***E04B 7/14*** | (2006.01) |
| ***E04C 3/07*** | (2006.01) |
| ***E04D 13/064*** | (2006.01) |
| ***E04H 15/34*** | (2006.01) |
| *E04C 3/04* | (2006.01) |

(52) U.S. Cl.
CPC ..... *E04D 13/064* (2013.01); *E04H 15/34* (2013.01); *E04C 2003/0413* (2013.01)

(58) Field of Classification Search
CPC ..... E04D 13/064; E04F 10/00; E04F 10/10; E04H 6/025; E04H 15/34
See application file for complete search history.

(56) References Cited

U.S. PATENT DOCUMENTS

| | | | | |
|---|---|---|---|---|
| 9,932,734 | B1 * | 4/2018 | Winter | E04B 1/1903 |
| 2011/0094569 | A1 * | 4/2011 | Hartley | H02S 20/10 136/251 |
| 2016/0333587 | A1 * | 11/2016 | Veys | E04F 10/0685 |
| 2018/0094426 | A1 * | 4/2018 | Winter | E04F 11/1817 |
| 2019/0249700 | A1 * | 8/2019 | Deng | F16B 7/0473 |
| 2022/0275633 | A1 * | 9/2022 | Aragones Pardo | E04B 1/34315 |

FOREIGN PATENT DOCUMENTS

| | | | |
|---|---|---|---|
| EP | 2351896 | A2 | 8/2011 |
| EP | 3587697 | A1 | 1/2020 |
| JP | H0630307 | U | 4/1994 |
| WO | 2019053523 | A1 | 3/2019 |
| WO | 2021214671 | A1 | 10/2021 |

* cited by examiner

TERRACE CANOPY

CROSS-REFERENCE TO RELATED APPLICATION(S)

This present application is a national stage application of International Patent Application No. PCT/IB2022/055103, filed Jun. 1, 2022, which claims priority to Belgium Patent Application No. 2021/5460, filed Jun. 10, 2021, the disclosures of which are hereby incorporated by reference in their entireties.

TECHNICAL FIELD

The present invention relates to a terrace canopy.

BACKGROUND

Terrace canopies are usually arranged to screen off or, on the contrary, to clear an outdoor area. For example, such screen devices are often arranged at homes, restaurants, shops, etc. in order to screen an outdoor terrace or the like from sun rays, precipitation and/or wind or, conversely, to temporarily let in sun's rays. These terrace canopies can, for example, be designed in the form of an awning, a pergola, a veranda, a carport, a pavilion, etc.

Such a terrace canopy typically comprises a roof frame which is at least partially supported by columns. Exceptionally, the roof frame can also be supported by another roof construction. The roof frame is generally constructed from several beams that are assembled into one or more frames into which a roof infill can be attached. The beams themselves are often a composite of several individual profiles. Such a roof frame is typically supported by four (or more) columns between which a wall infill can be provided. Also, fewer columns can be used in case the roof frame is supported by other structures, such as a wall of an already existing structure.

The roof infill can be stationary or movable, for example a sliding roof. The roof infill of a sliding roof can, for example, consist of a roll-up cloth or screen, blades that rotate around their axis, or of segments that can slide over each other. The segments can be panels that are partly made of (laminated) glass or plastic, such as PC or PMMA. Depending on the choice of material, the light transmission and robustness of the roof can be adjusted to the desired application. The wall infill can also be stationary or movable. Examples are a rollable cloth or screen or movable, i.e. slidable or foldable, panels.

Furthermore, various types of columns have been developed that, in addition to their general support function, contain other functions. For example, the columns may be adapted to also provide supply lines to electrical equipment and/or to comprise drainage pipes for drainage of precipitation and/or to comprise guide profiles for a screen. Preferably, the column should be able to comprise all of the functions described above and also be finished as aesthetically as possible from the outside.

BE 2014/0015 discloses a terrace canopy constructed from columns and beams. In particular, the terrace canopy comprises a support pillar provided with a cavity for discharging precipitation incident on the terrace canopy towards a ground surface and at least two beams, each provided with an internal gutter for discharging precipitation incident on the terrace canopy to a head end of the beam. Headboards are used for the connection of the beams to the support pillar. In particular, for each beam a headboard is provided that forms the connection between each beam and the support pillar. Concretely, the integrally formed headboard comprises an upper part which is secured by means of screws on a head end of the beam, in particular by tightly screwing the screws into screw channels provided thereto in the beams. From the upper part a pin extends downwardly which is mounted in the cavity of the support pillar.

However, it has been found that the terrace canopy disclosed in BE 2014/0015 can collapse under the high loads in certain weather conditions, for example in the event of an excess of wind and/or precipitation.

In the context of such a problem, the current applicant has already filed a Belgian patent application under number BE 2020/5265 and an international patent application under number PCT/IB2021/053273 published as WO 2021/214671 A1.

These patent applications disclose the use of a corner piece for connecting the beams to the support pillar. More specifically, these patent applications disclose a terrace canopy comprising a support pillar which extends in a substantially vertical direction; a first and a second beam which each extend in a substantially horizontal direction, wherein each beam is provided with a headboard at at least one end; and a corner element which is positioned between and secured to the support pillar and the beams and provided with a first and a second wall portion, wherein the headboard of the first beam is attached against the first wall portion of the corner element and wherein the headboard of the second beam is attached to the second wall portion of the corner element. The corner element is also provided with a plurality of support legs which are located below the wall portions and extend towards the support pillar and are secured thereto. The support legs provide the necessary space to integrate water drainage from the beams to the support pillar in the terrace canopy. Bolts and bolt openings provided thereto are used for the specific connection between the end panels and the corner element.

EP 3 587 697 A1 discloses a terrace canopy constructed from columns and beams. In particular, the terrace canopy comprises a support pillar provided with a cavity for discharging precipitation incident on the terrace canopy towards a ground surface and at least two beams, which are each provided with a gutter for discharging precipitation incident on the terrace canopy to a front end of the beam. Headboards are used for the connection of the beams to the support pillar. In particular, a headboard per beam is provided, which forms the front end face of the front beam. In addition, an L-shaped corner piece is provided that serves as a corner connection between a column and the beams, whereby the corner piece is secured to the headboards and to the top surface of the support pillar.

A drawback of the known L-shaped corner piece is the complex design required for the necessary functionality. First, several openings must be made in the corner piece (on the one hand for water drainage and on the other hand for cables). In addition, an upright wall is also required on the bottom surface for water guidance. A further drawback of the known L-shaped corner piece is that it is only suitable for connecting two corner-forming beams with a support pillar. However, connection points are also possible in a terrace canopy where more than two beams meet (e.g. T-connection with three beams or a cross-connection with four beams) or where two beams meet in each other's extension. The known L-shaped corner piece is not suitable for a connection of such a node.

SUMMARY

It is an object of the present invention to improve the connection between the beams and the column.

This object is achieved in that mutually cooperating alignment means are provided between each wall portion and the headboard attached thereto, which mutually cooperating alignment means are configured for aligning a beam with respect to the support pillar, wherein the mutually cooperating alignment means comprise a tongue and groove.

During the further development of the terrace canopy described in BE 2020/5265 and PCT/IB2021/053273, the inventors found that the beam is not always correctly positioned with respect to the support pillar. In particular, horizontal shifts and/or rotations about the vertical axis of the beam with respect to the support pillar occurred.

A possible explanation for this incorrect positioning can be found in the specific manufacture of the various components. The headboards are normally manufactured as castings with the bolt openings provided therein. The corner element is normally manufactured through an extrusion process and the bolt openings are post-drilled. Inherently, there are tolerances during every manufacturing step. To accommodate these tolerances, the bolt openings in the headboards are typically made too large. These oversized bolt openings are partly responsible for the incorrect positioning of the beam with respect to the support pillar.

Such a problem was less (or not) encountered with the terrace canopy disclosed in BE 2014/0015. There, each headboard was provided with a vertical pin that slides into a cavity inside the support pillar. This pin ensured a correct positioning.

Such a problem probably also arises with the terrace canopy disclosed in EP 3 587 697 A1 where two flat elements (i.e. the front end face of the front beam and a face of the L-shaped corner element) are connected to each other by means of bolts which extend through preformed openings and/or slots. Here, too, it is plausible that the manufacturing tolerances of the various parts, openings and slots may lead to an incorrect alignment of the beams with respect to the column.

By providing mutually cooperating alignment means between each wall portion and the headboard attached against it, the mutual positioning between the headboard and the wall portion is correct (or at least better than in the absence of the alignment means). Because the headboard is a stationary part of the beam and because the corner element is attached to the support pillar, the positioning of the beam with respect to the support pillar is therefore also correct (or at least better than in the absence of the alignment means).

In addition, a tongue and groove as alignment means ensure an alignment at several different locations of the headboard. By ensuring a mutual alignment at several, in particular at least two, separate locations of the headboard and the wall portion, a rotation between the beam and the support pillar is avoided (or at least limited).

More specifically, the mutually cooperating alignment means are for mutually aligning a vertical axis of a beam with respect to a vertical axis of the support pillar and/or for mutually aligning a lower surface of a beam with respect to an upper surface of the support pillar and/or for mutually aligning a side face of a beam with respect to a side face of the support pillar.

Correctly positioning a beam with respect to a column in a terrace canopy is a problem that has already been discussed in EP 2 351 896 A2. In the terrace canopy disclosed therein, the beam is provided at its end with a headboard/end piece and the columns are provided on their outer surface with prism-shaped cavities. By placing the headboard into the prism-shaped cavities, there is a close abutment of the beam against the column. EP 2 351 896 A2 does not disclose anything about avoiding horizontal shifts and/or rotations about the vertical axis of the beam with respect to the column.

In an embodiment of the present invention, each beam comprises a height direction, wherein the mutually cooperating alignment means are configured for aligning the height direction of a beam with respect to said substantially vertical direction. In this embodiment, the mutually cooperating alignment means prevent (or at least reduce) the rotation between the beam and the support pillar. The alignment means preferably ensure that the height direction of the beam is rotated at most 2°, in particular at most 1°, more in particular at most 0.5° and most in particular at most 0.2° with respect to the substantially vertical direction.

In an embodiment of the present invention, each beam comprises a width direction, wherein the mutually cooperating alignment means are configured for alignment in the width direction of a beam with respect to the support pillar. In this embodiment, the mutually cooperating alignment means prevent (or at least reduce) the horizontal shift between the beam and the support pillar. Preferably, the alignment means ensure that the beam is shifted at most 2 mm, in particular at most 1 mm, more in particular at most 0.5 mm and most in particular at most 0.2 mm, with respect to the support pillar.

In an embodiment of the present invention, the tongue and groove extend in the substantially vertical direction. This is advantageous for the manufacture of the corner element. Such a tongue and groove can, in fact, be produced immediately during the extrusion process for manufacturing the corner piece. This thus saves additional manufacturing steps.

In an embodiment of the present invention, the tongue and groove have mutual contact surfaces which are oriented obliquely with respect to the corresponding wall portion. The provision of obliquely oriented contact surfaces offers an easy installation and ensures a close connection compared to contact surfaces that are perpendicular to the wall portion. In particular, with right-angled contact surfaces, the headboard must be perfectly aligned with the wall portion of the corner element before installation, which is not easy. In addition, clearance must still be provided at right angle contact surfaces to accommodate manufacturing tolerances. With angled contact surfaces the initial alignment is not crucial which simplifies installation. In particular, when the connection (e.g. the bolt) is tightened, the oblique contact surfaces automatically close against each other.

In an embodiment of the present invention, the groove is provided in the wall portions of the corner element, wherein the tongue is provided on each headboard. This embodiment is more compact compared to the reverse (i.e. the groove provided on the headboard and the tongue in the wall portions). This is because there is space on the inside of the corner element for the recess for the groove without the corner element having to be made larger. Such space is not present at the headboard, such that the inverted embodiment would lead to a less compact terrace canopy.

In an embodiment of the present invention, the mutually cooperating alignment means comprise a further tongue and groove which are preferably identical to the tongue and groove. Using multiple sets of tongue-groove alignments provides a more robust terrace canopy. This is because the further tongue-groove can absorb errors which are present in the tongue-groove. In addition, the forces are distributed over several contact surfaces, such that the pressure on each individual contact surface can be decreased and maintained.

In an embodiment of the present invention, the corner element exhibits a rotational symmetry of order three and preferably four or higher. Due to such rotational symmetry, the corner element can be arranged in the terrace canopy independently of the direction and the bearing capacity and strength are also the same in at least three, preferably at least four directions, which is advantageous because in a terrace canopy, typically a maximum of four beams are attached to one support pillar. Typical examples are a corner element with a substantially triangular, square, hexagonal, circular, etc. cross section.

In an embodiment of the present invention, the terrace canopy further comprises a third beam and/or a fourth beam, wherein the corner element is further provided with a third and/or a fourth wall portion, wherein the headboard of the third beam is attached to the third wall portion of the corner element and/or wherein the headboard of the fourth beam is attached to the fourth wall portion of the corner element. In this embodiment, the advantages of the alignment means are also applied to the three or four beams connected to the support pillar.

In an embodiment of the present invention, each headboard is provided with at least one bolt opening and the corner element is provided with a corresponding bolt opening in each wall portion for fixing the headboard to the corner element. Bolt openings and bolts are a simple way of connecting two elements together.

In an embodiment of the present invention, one of said at least one bolt opening and said corresponding bolt opening is provided on a bottom of the groove. Such positioning of the tongue-groove minimizes the stresses in the headboard and/or corner piece compared to a bolt opening that lies outside the tongue-groove. With such a configuration, forces act on the headboard and/or the corner piece near the bolt connection and on the walls of the tongue-groove, these forces then cause an internal stress on the headboard and/or on the corner piece. Such stresses can damage the headboard and/or the corner piece. By providing the bolt openings in the tongue-groove, the forces are exerted close to each other such that less stress is created.

In an embodiment of the present invention, the corner element is integrally formed, preferably by means of an extrusion process, and/or each headboard is integrally formed, preferably by means of a casting process. Such processes are known to the person skilled in the art and can be applied on a commercial scale.

In an embodiment of the present invention, each headboard includes at least one hook configured to hook onto an upper end of each wall portion of the corner element for attaching a headboard to the corner element. The hooks are easy to use and can be used, for example, during installation to first hook the beams and then fix them with the bolts without having to support them.

In an embodiment of the present invention, at least one of the beams is provided with a gutter for discharging precipitation incident on the terrace canopy to a front end of the beam, wherein the support pillar is provided with a cavity for discharging precipitation incident on the terrace canopy towards a ground surface. Preferably, the corner element is provided with at least one passage communicating said gutter to the cavity of the support pillar, which at least one passage is located in particular below said wall portions in the substantially vertical direction. Providing a gutter in one of the beams is advantageous for the controlled drainage of precipitation such that the space under the terrace canopy remains substantially dry. By providing a passage in the corner element, it is also possible to largely hide the water drainage, which contributes to a sleek finish of the terrace canopy. By providing the passage under the wall portions, the strength of the connection between the wall portions and the headboards can be maximized, because there must be no space for water drainage.

In an embodiment of the present invention, the corner element is provided with one or, preferably, multiple support legs extending towards the support pillar. The support legs form a simple way of bridging the height difference between the connection of the corner element to the beams and the connection of the corner element to the support column, while exposing passages for water drainage. This height difference is typically present such that the gutter of the beam, in particular the internal gutter of the beam, can communicate with the support pillar.

BRIEF DESCRIPTION OF THE DRAWINGS

The invention will be explained in further detail below with reference to the following description and the accompanying drawings.

DETAILED DESCRIPTION

Figure 1:
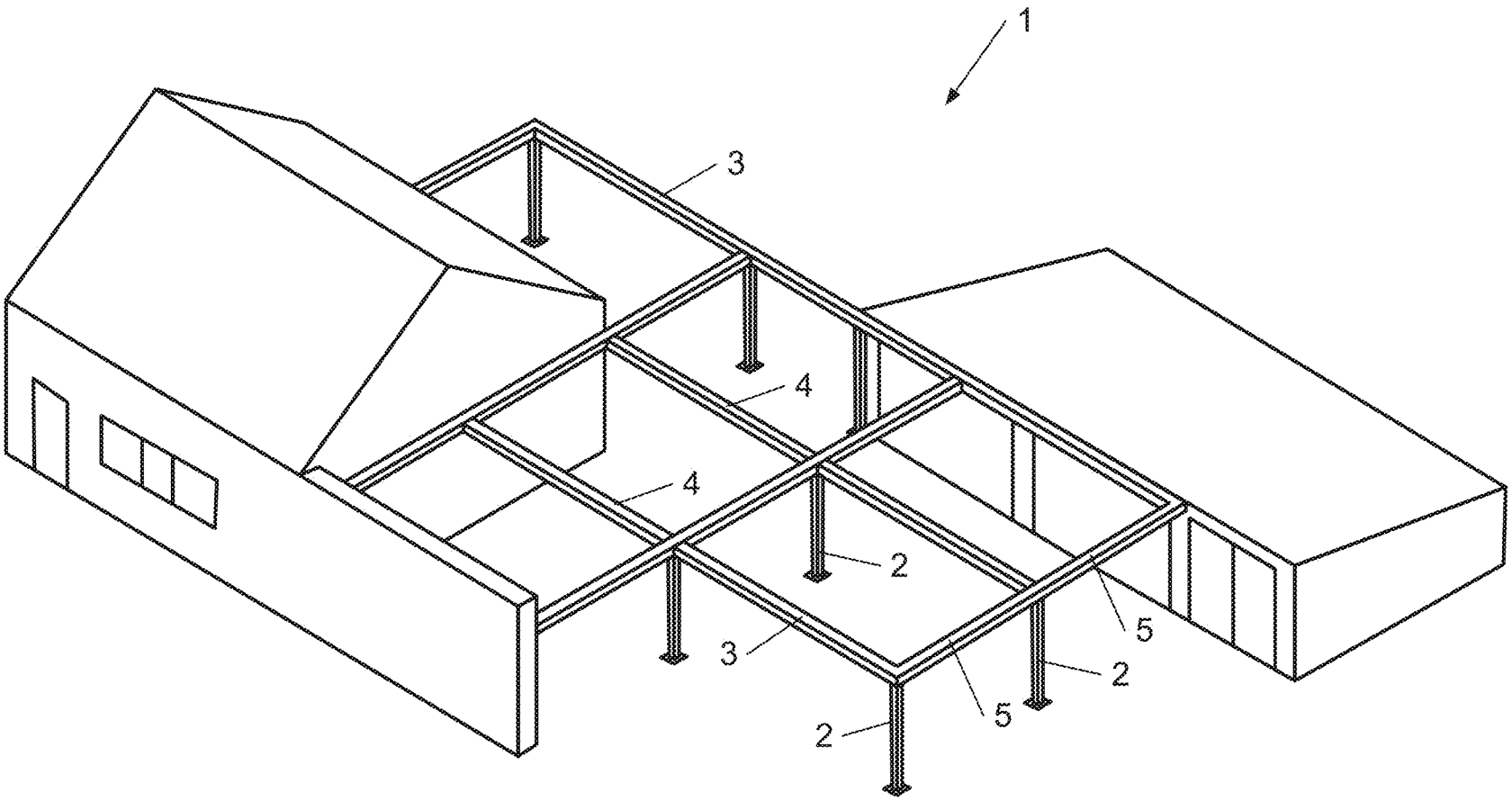
FIG. 1 shows a schematic view of a terrace canopy according to the invention.

Hereinafter, the present invention will be described with reference to particular embodiments and with reference to particular drawings, but the invention is not limited thereto and is defined only by the claims. The drawings shown herein are only schematic representations and are not limiting. In the drawings, the dimensions of certain parts may be enlarged, meaning that the parts in question are not shown to scale, for illustrative purposes only. The dimensions and relative dimensions do not necessarily correspond to actual practical embodiments of the invention.

In addition, terms such as “first”, “second”, “third”, and the like are used in the description and in the claims to distinguish between similar elements and not necessarily to indicate a sequential or chronological order. The terms in question are interchangeable in appropriate circumstances, and the embodiments of the invention may operate in orders other than those described or illustrated herein.

In addition, terms such as "top", "bottom", "above", "below", and the like are used in the description and in the claims for descriptive purposes. The terms so used are interchangeable in appropriate circumstances, and the embodiments of the invention may operate in orientations other than those described or illustrated herein.

The term "comprising" and derivative terms, as used in the claims, should or should not be construed as being limited to the means set forth in each case thereafter; the term does not exclude other elements or steps. The term shall be interpreted as a specification of the stated properties, integers, steps, or components referred to, without however excluding the presence or addition of one or more additional properties, integers, steps, or components, or groups thereof. The scope of an expression such as "a device comprising the means A and B" is therefore not limited only to devices consisting purely of components A and B. What is meant, on the contrary, is that, for the purposes of the present invention, the only relevant components are A and B.

Figure 3:
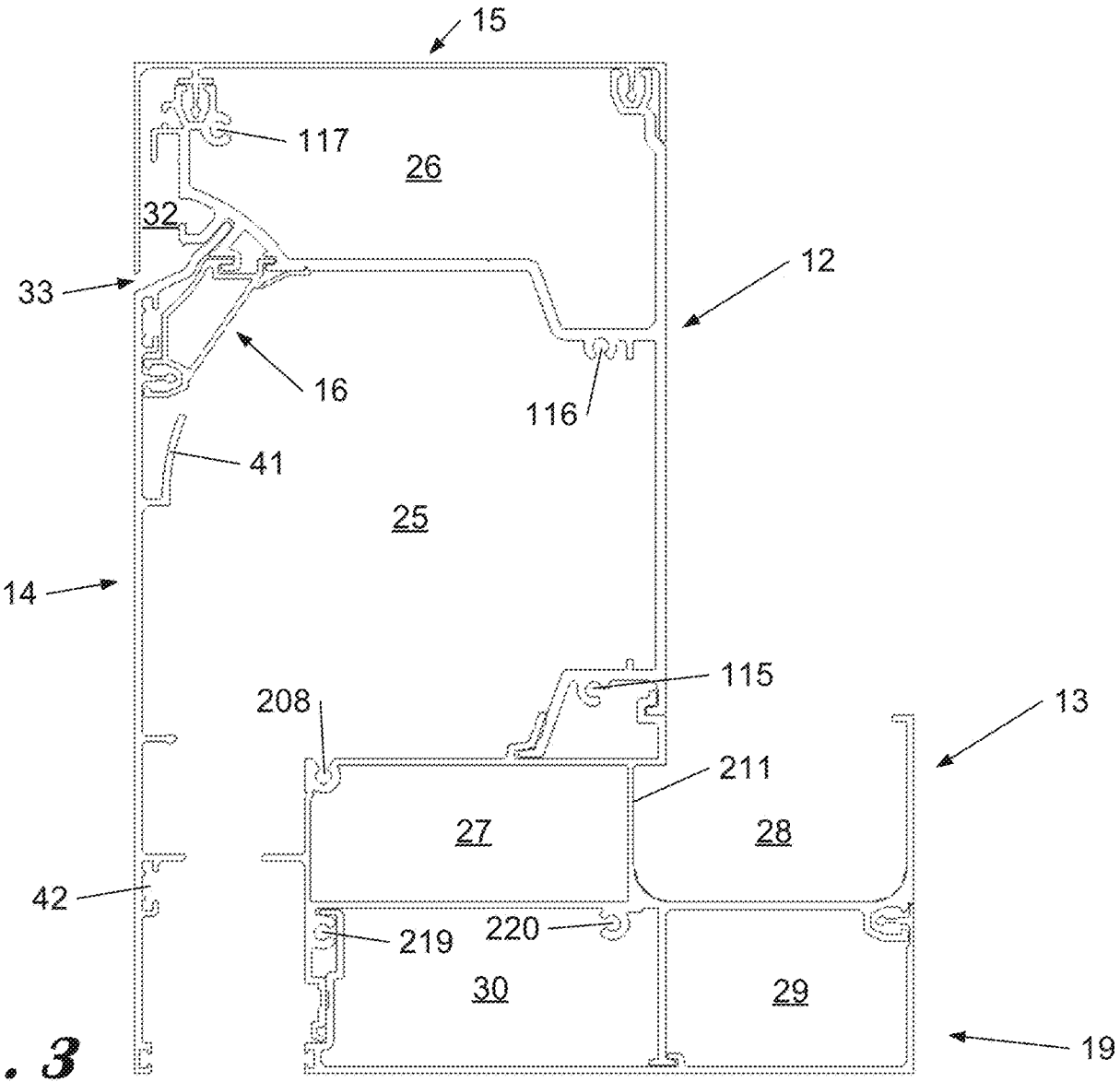
FIG. 3 shows a section through the external pivot beam of the terrace canopy of FIG. 2.

With regard to FIG. 3, any reference to an orientation of the beams will be interpreted with reference to the position when mounted in the terrace canopy. In this way, there are four orientations, namely above, below, outside and inside. Here, "above" refers to the part of the beam that is or will be oriented towards the top surface (the sky, e.g. the open sky), "below" refers to the part of the beam that is or will be oriented towards the base plane (the earth, e.g. the terrace floor), "outside" to the part of the beam that is or will be oriented away from the roof, i.e. away from the roof infill (i.e. the left side in FIG. 3) and "inside" to the part of the beam that is or will be oriented towards the inside of the roof, i.e. towards the roof infill (i.e. the right side in FIG. 3).

The term "substantially" includes variations of +/−10% or less, preferably +/−5% or less, more preferably +/−1% or less, and more preferably +/−0.1% or less, of the specified condition, in as far as the variations are applicable to function in the disclosed invention. It is to be understood that the term "substantially A" is intended to also include "A".

FIG. 1 illustrates a terrace canopy 1 for a ground surface, for example a terrace or garden. The terrace canopy comprises a plurality of columns 2 supporting different beams 3, 4, 5. The columns and beams together form frames to which wall infills 6 and/or roof coverings 7 can be attached, as described hereafter. The terrace canopy 1 comprises three types of beams 3, 4, 5, namely:

- a beam 3 that serves as an external pivot beam 3 at the outside of the terrace canopy 1;
- a beam 4 that serves centrally as a central pivot beam 4 in the terrace canopy 1; and
- a beam 5 that serves as tension beam 5.

It will also be appreciated that the beams 3, 4, 5 can be attached to other structures, for example a wall or facade, instead of solely lying on columns 2 as shown in FIG. 1. In such a way the terrace canopy 1 can be used in general for shielding an outdoor space, as well as an indoor space.

Figure 2:
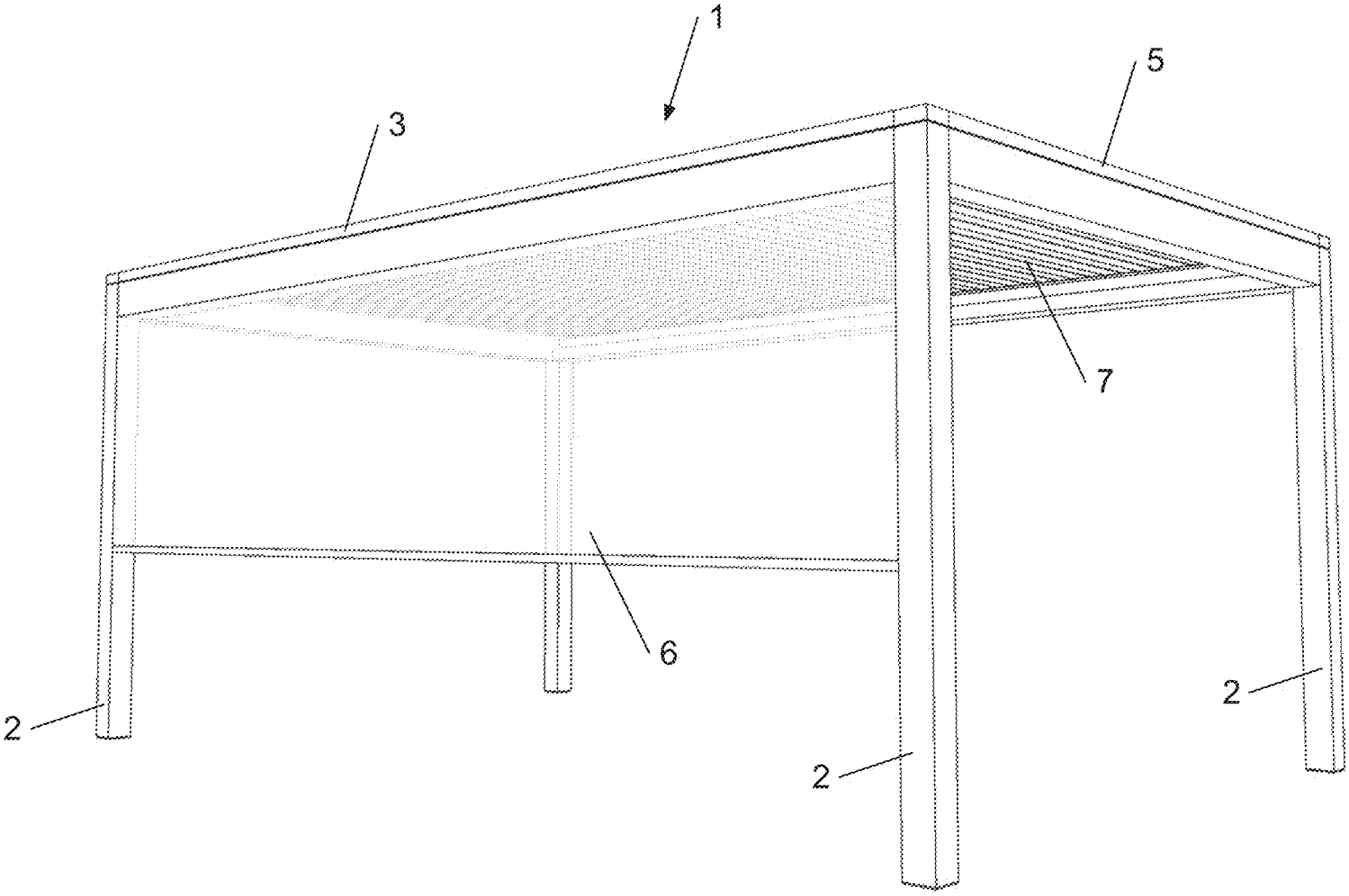
FIG. 2 shows an embodiment of the terrace canopy with a wall infill.

FIG. 2 shows a terrace canopy 1 with a wall infill 6. The terrace canopy 1 has four support columns 2 which support a frame, also called a roof frame. The frame is formed from two external pivot beams 3 and two tension beams 5 between which a roof covering 7 is provided.

In the embodiment shown, the roof covering 7 is formed by slats which are rotatably attached at their front ends to pivot beams 3. The slats are rotatable between an open position and a closed position. In the open position there is an intermediate space between the slats through which, for example, air can be introduced into the underlying space or can leave this underlying space. In the closed position, the slats form a closed roof with which the underlying space can be shielded from, for example, wind and/or precipitation, such as rain, hail or snow. For the discharge of precipitation, the slats are typically inclined towards one of the two pivot beams 3.

The slats are typically made of a rigid material. This can be aluminium, for example. Aluminium has many advantages as a material, because it is robust and light at the same time, resistant to adverse weather conditions and requires little maintenance. However, other materials are also suitable and their advantages or disadvantages are believed to be known to the person skilled in the art. A slat can be produced using different techniques depending on the material, including extrusion, milling, setting, casting, welding, and so on. The appropriate manufacturing technique is believed to be known to the person skilled in the art. Preferably, the slats are manufactured by means of an extrusion process. Optionally, filling elements of for example polycarbonate, glass, wood, etc. can be used to at least partially fill the hollow slats, for example to obtain another appearance of the slats.

In an embodiment, additionally the slats can, in their open position, be slidably provided in the terrace canopy 1, in order to further increase the control options in terms of light incidence, radiant heat and ventilation.

More generally, the roof covering 7 is arranged stationary or movably. A movable roof covering comprises, for example, tiltable and/or slidable slats (as described above) and/or roll-in and roll-out screens and/or slidable panels. In their closed position, the individual elements of the movable roof covering 7 form a substantially watertight roof with which the underlying space can be shielded from, for example, wind and/or precipitation, such as rain, hail or snow. This roof covering 7 is typically drained to the pivot beams 3, 4 and from there directly or via the tension beams 5 to the columns 2. By shifting and/or rotating the slats and/or the panels and/or by rolling up a screen, the roof covering 7 can be opened and/or closed at least partially in order to be able to determine the incidence of light, radiant heat, ventilation, precipitation, etc. to the space under the roof covering 7 as desired.

Wall infills 6 are typically intended to shield openings under the terrace canopy 1 between the columns 2. The wall infills 6 can be arranged stationary or movably. Movable side walls include, for example, retractable and roll-in and roll-out screens and/or wall elements that are slidably arranged with respect to each other, etc. Stationary side walls can be manufactured from different materials, such as plastic, glass, metal, textile, wood, etc. Combinations of different wall infills 6 are also possible.

FIG. 2 illustrates a wall infill in the form of a roll-in and roll-out screen 6. The screen 6 extends between two adjacent columns 2 and can be rolled out from the external pivot beam 3. The screen 6 mainly serves as a wind and/or sun screen.

In general, the beams 3, 4, 5 are constructed from one or more profiles as described hereafter. The profiles are typically made of a rigid material. This can be aluminium, for example. Aluminium has many advantages as a profile material, because it is robust and light at the same time, resistant to adverse weather conditions and requires little maintenance. However, other materials are also suitable and their advantages or disadvantages are believed to be known to the person skilled in the art. A profile can be produced using different techniques depending on the material, including extrusion, milling, setting, casting, welding, etc., with extrusion being the preferred choice. The appropriate manufacturing technique is believed to be known to the person skilled in the art.

Terrace canopies 1 come in different sizes and dimensions, as do the beams 3, 4, 5 thereof. An important dimension is the length of the beams 3, 4, 5. On the one hand, there is a demand for the longest possible beam in order to span as large a surface as possible with the terrace canopy with a minimum of columns. On the other hand, there are mechanical limitations on the length of the beam. Namely, the longer the beam, the more deflection is present, which deflection is of course not desired. Although the deflection can be compensated for by reinforcing the beam, this in turn leads to a less compact beam and increased material costs. Account must also be taken of the roof arrangement that is fully supported by the beams. It is also possible that certain wall infills are also supported by the beams. Of course, these additional load capacities also influence the deflection of the beam. In an embodiment, the beams 3, 4, 5 have a maximum length of 6 meters.

In general, the beams 3, 4, 5 of the terrace canopy 1 are hollow, as can be seen from FIG. 3. The beams 3, 4, 5 are composed of a plurality of profiles. Hereafter, the different profiles of the beams and their mutual connection are briefly discussed. It goes without saying that several variants for both the composition of the beams and the mutual connection of the profiles are conceivable, as well as that the specific design of the profiles can differ. In addition, it is also possible that the functionality of different profiles can be combined in one and the same integrally manufactured profile, for example it is possible to form the base profile 12 with the external gutter profile 13 as an integrally formed core profile.

To form the beams 3, 4, 5, the profiles are connected to each other in a specific way. Generally, pin connections and/or hook connections are used. In a pin connection, typically an elastic element (not shown) is present in a female element, for example a slot element, into which a male element, for example a pin, engages. Hence, a pin connection generally comprises an elastically engaging male and female element. For this purpose, an additional elastic element may be provided, but this is not necessarily the case. The elasticity can also arise from the shaping of the male and female elements. Hook connections typically involve two elements with a design such that they hook into each other. This does not involve an elastic element and the connection is taken apart by moving the elements away from each other in the correct direction.

In addition, in general, for each connection of two profiles to each other, use is made of two separate connections. This promotes the strength of the connection, but mainly contributes to the correct mutual positioning of the profiles. This is because, if only one connection is used for two profiles, there is more clearance in the mutual positioning, which can give rise to a deviating positioning, in particular due to wind loads and/or precipitation loads.

FIG. 3 shows a cross-section through the external pivot beam 3 of the terrace canopy of FIG. 2. The external pivot beam 3 is intended to be placed on the outside of the terrace canopy 1 and must provide for water drainage from precipitation incident on the terrace canopy. In particular, this precipitation can be collected, for example, by a louvered roof 7 that drains precipitation to this pivot beam 3. The roof infill 7 drains the precipitation to the pivot beam 3 where it is collected in the external gutter 28. Between the external gutter 28 and the cavity 27, the partition wall 211 is present, which is provided with one or more openings, for example a series of perforations, such that the precipitation from the external gutter 28 is diverted to the cavity 27. That is why the bottom of the external gutter 28 also preferably slopes towards the cavity 27. The cavity 27 serves as an internal gutter for the passage of precipitation from one or more connecting pivot beams 3 to a column 2, along which this precipitation can leave the terrace canopy 1, as described hereafter.

The pivot beam 3 is constructed from a number of profiles, namely a base profile 12, a double gutter profile 13, a front cover 14, a cover profile 15, a connecting profile 16 and a closing profile 19. A screen cavity 25 is formed by the base profile 12, the double gutter profile 13 and the front cover 14. The screen cavity 25 is intended for holding a roll-in and roll-out screen 6 that serves as side wall of the terrace canopy 1, as shown in FIG. 2. The cover profile 15 serves to close off a technical space 26 in the external pivot beam 3. This technical space 26 can serve to house drive means for tilting slats of the roof covering 7 and/or cabling for, for example, lighting, etc. The front cover 14 and the cover profile 15 are both removable. As a result, the screen cavity 25 and the technical space 26 are accessible such that adjustments, modifications and/or repairs can be made, if necessary.

The front cover 14 typically forms the outside of the external pivot beam 3 and is attached to the base profile 12 through a connecting profile 16. In the embodiments shown, the front cover 14 is further provided with a reinforcing rib 41 and a slot 42. The reinforcing rib 41 contributes to the rigidity of the front cover 14 and is useful for obtaining the required resistance under higher loads, especially when bridging relatively long lengths (e.g. lengths greater than 4 meters). The slot 42 is provided for arranging therein a holder (not shown) which serves as an abutment for the screen 6 when it is being rolled up. Alternatively, the slot 42 or another wall may serve as such screen roll abutment.

The pivot beam 3 also comprises a space 32 between the cover profile 15 and a part of the base profile 12. The double gutter profile 13 is also provided with spaces 29, 30 which are closed by means of the substantially U-shaped closing profile 19. If desired, these rooms 29, 30, 32 may also be functionally used, e.g. as a wall holder and/or lighting holder.

Furthermore, the external pivot beam 3 is provided with screw channels 115, 116, 117, 208, 219, 220 for screwing a headboard to one end of this beam 3 by means of screws or bolts for the purpose of connecting the beam to a column of the terrace canopy 1. Screw channel 115 is provided on the underside of the base profile 12; screw channel 116 is provided centrally in the base profile 12 in the screen cavity 25; screw channel 117 is provided at the top side of the base profile 12 in the technical room 26; screw channel 208 is provided at the upper outer corner of the inner gutter 27; and the screw channels 219, 220 are provided under the inner gutter 27 on either side thereof. Of course, more or fewer screw channels are also possible and/or their positioning may be different.

The terrace canopy 1 of FIG. 2 also comprises two tension beams 5. A cross-section thereof is not shown as it is quite similar to that of the pivot beam 3, with the main difference being the absence of an external gutter 28. In the tension beam 5 are screw channels are provided for screwing a headboard to an end of this beam 5 by means of screws or bolts for the purpose of connecting the beam to a column of the terrace canopy 1. Preferably, the screw channels of the tension beam 5 have the same positioning as with the pivot bar 3.

Figure 4:
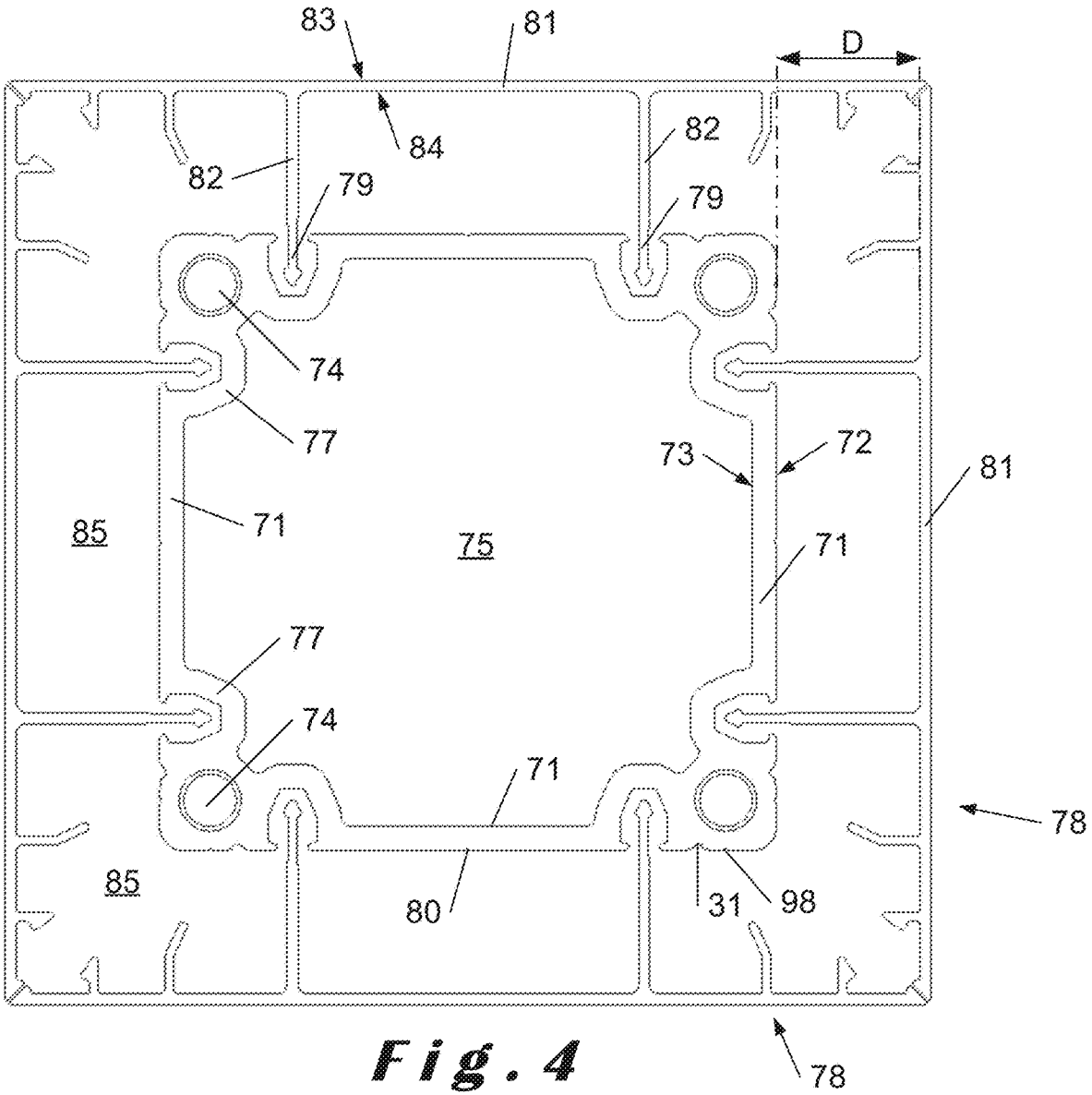
FIG. 4 shows a section through the column of the terrace canopy of FIG. 2.

A cross-section through a column 2 of the terrace canopy 1 is shown in FIG. 4. The column 2 comprises an integrally formed core part (generally denoted by reference numeral 70). In particular, the core part 70 is formed by a profile of the same or similar type as the profiles of the beams 3, 4, 5. The profile 70 is typically manufactured from a rigid material. This can be aluminium, for example. Aluminium has many advantages as a material, because it is robust and light at the same time, resistant to adverse weather conditions and requires little maintenance. However, other materials are also suitable and their advantages or disadvantages are believed to be known to the person skilled in the art. A profile can be produced using different techniques depending on the material, including extrusion, milling, setting, casting, welding, etc., with extrusion being the preferred choice. The appropriate manufacturing technique is believed to be known to the person skilled in the art. Preferably, the profile 70 is extruded from aluminium.

The profile 70 serves as a support pillar for the terrace canopy 1. In particular, substantially the entire weight of the beams 3, 4, 5 and the elements connected thereto, such as the side walls 6 or the roof covering 7, is supported by the support pillar 70.

The core profile 70 has a substantially square shape in the embodiments shown. Hence, each core profile 70 has four side walls 71, each with an outer side 72 and an inner side 73. Each outer side 73 is provided with two mounting means 77, in particular mounting slots, preferably female pin connection means. These slots 77 serve for the attachment of finishing profiles 78 by means of a corresponding connection means 79, preferably a pin. It will be readily appreciated that the pin connection 79 is only one example of a way of attaching the finishing profiles 78 to the core profile 70 and that other ways are known to the person skilled in the art. It will also be readily appreciated that the slots 77 need not necessarily be continuous, although this is preferred since the core portion 70 is preferably manufactured by an extrusion process. The slots 77 are positioned symmetrically with respect to the center of a side wall 71, such that the attachment points of a finishing profile 78 to the side wall 71 are also symmetrical, which is advantageous.

Although the use of two mounting means 77 per side wall 71 is preferred, in view of the use of two separate fastenings between two profiles, less clearance is allowed in the mutual positioning, which clearance can lead to a different positioning, in particular due to wind loads and/or precipitation loads, is a connection with only one application means per side wall also possible. On the other hand, more than two application means per side wall can also be provided.

It will be readily appreciated that the core profile 70 as described above is not limited to a substantially square shape. Also, the four side walls 71 can be arranged in a different geometric shape, for example a rectangle or parallelogram. In addition, it is also possible to provide more or fewer side walls 71 per core profile 70, in particular triangular, hexagonal or octagonal core profiles 70 are also possible. Furthermore, the core profile 70 may also be ellipsoidal, in particular circular, with the desired number of mounting slots then provided in the one continuous sidewall comprising the core profile 70. Also, a core profile 70 may have a cross-section which has a non-closed shape, for example a U-shaped or L-shaped cross-section. The open side(s) of such a core profile are then covered by corresponding finishing profiles 78.

The column 2 is further provided with four finishing profiles 78, namely one on each side wall 71. Each finishing profile 78 is provided with a flat outer wall 81, the outer side 83 of which determines the visual appearance of the column 2. In other words, the finishing profile 78 hides the core profile 70 in the mounted terrace canopy 1. Furthermore, each finishing profile 78 is provided with pins 79, namely one pin per mounting slot 77. The pins 79 are connected to the outer wall 81 by means of walls 82 which serve as spacers. In particular, the length of the walls 82 determines the distance D between the outer side 72 of a wall 71 and the inner side 84 of the outer wall 81. Cavities 85 are also created by providing spacers 82. One or more of these cavities 85 can be used for integrating electrical lines that serve to drive the wall infill 6, the roof infill 7 and/or other electrically driven equipment. It will be readily appreciated that the spacers 82 may also be provided with elements other than walls. For example, the wall may not be continuous in the longitudinal direction of the finishing profile 78, optionally, pins, screws, bolts, etc. can be used as spacers.

The connection of the support pillar 70 to the beams 3, 4, 5 will be described with reference to FIGS. 5 to 9.

Figure 5:
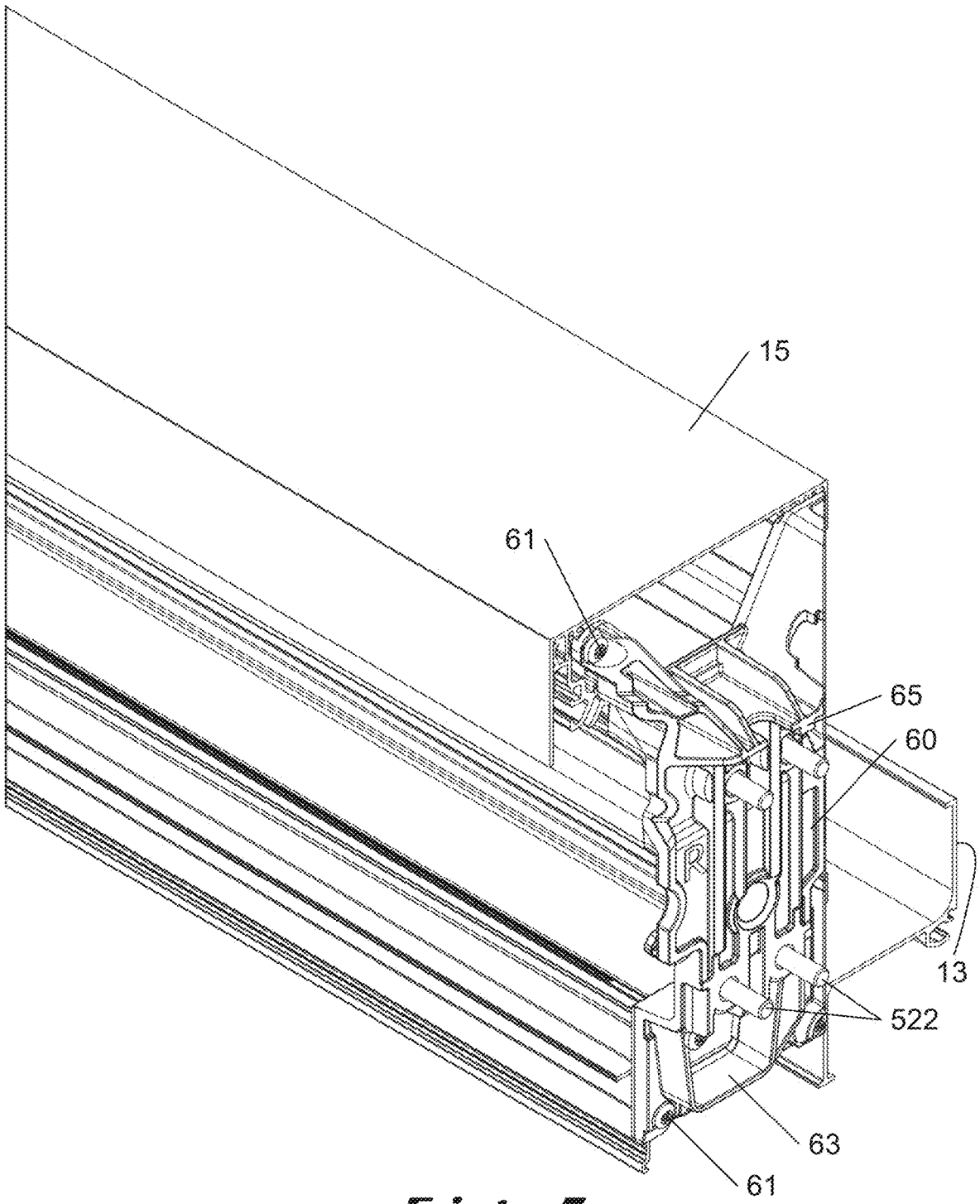
FIG. 5 shows a perspective view of the pivot beam of FIG. 3 with a headboard mounted thereon.

FIG. 5 shows the connection of a headboard 60 with the end of the external pivot beam 3 of FIG. 3. For that connection, the beams 3, 5 are provided with screw channels 115, 116, 117, 208, 219, 220 which are provided for each beam on an identical position. In this way, one and the same headboard 60 can be connected to any embodiment of external pivot beam 3 and tension beam 5. Alternatively, it is of course also possible to provide different headboards 60 for different beams 3, 4, 5 if the positioning of the screw channels varies. It is also possible to manufacture the headboard 60 integrally with the beams 3, 4, 5.

Figure 6A:
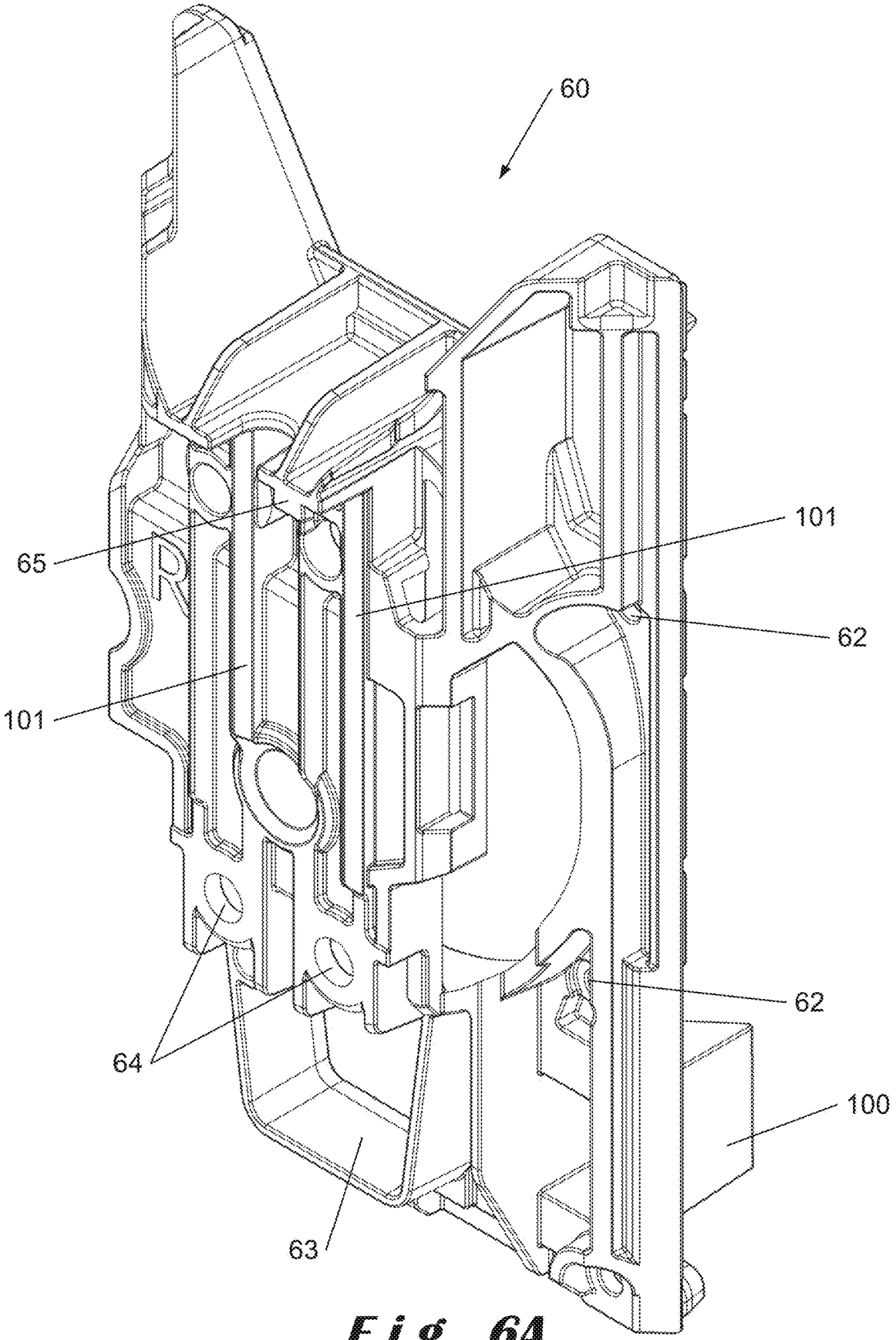
FIGS. 6A and 6B show a perspective view of the headboard of FIG. 5.
Figure 6B:
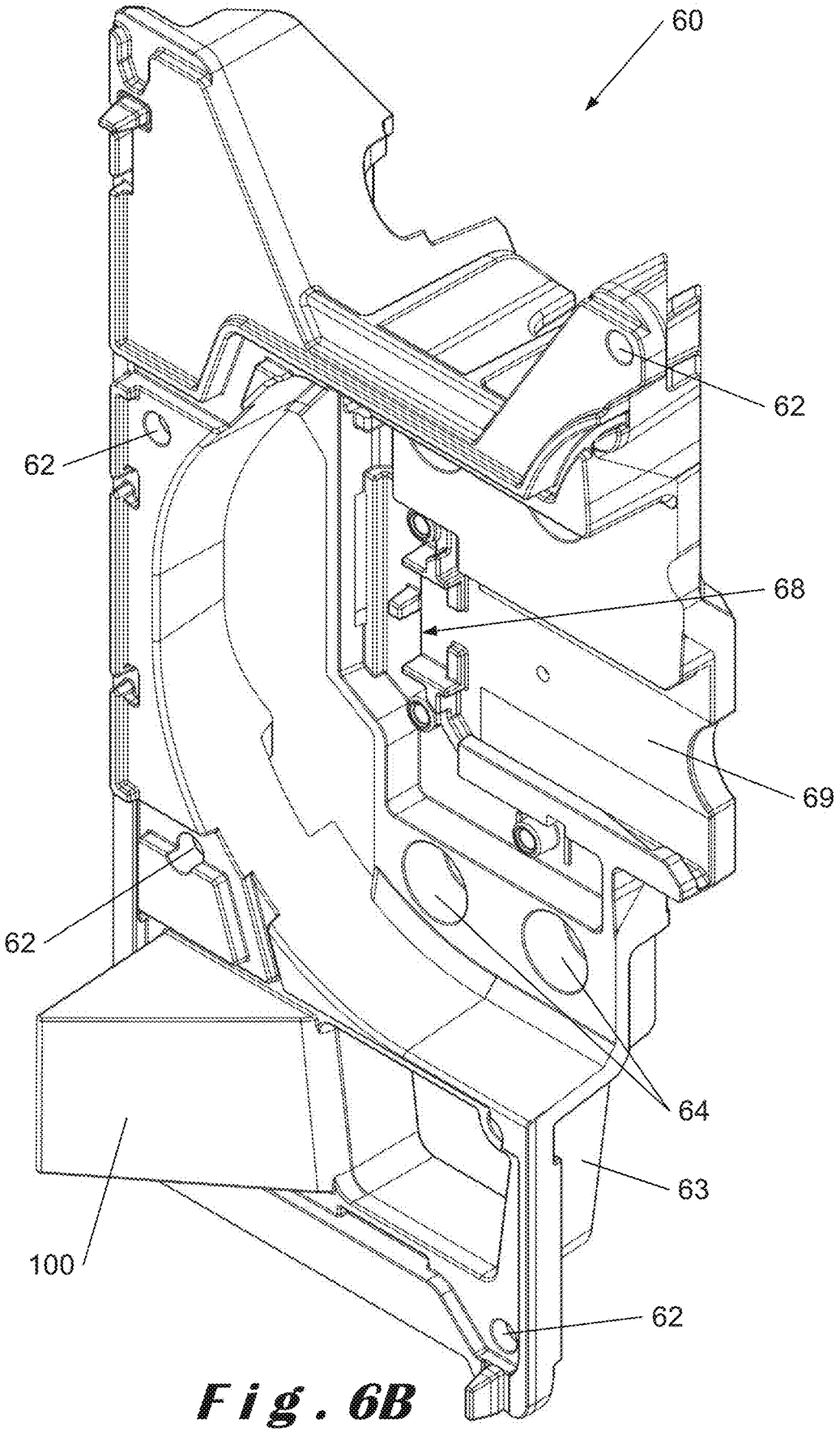
Figure 6C:
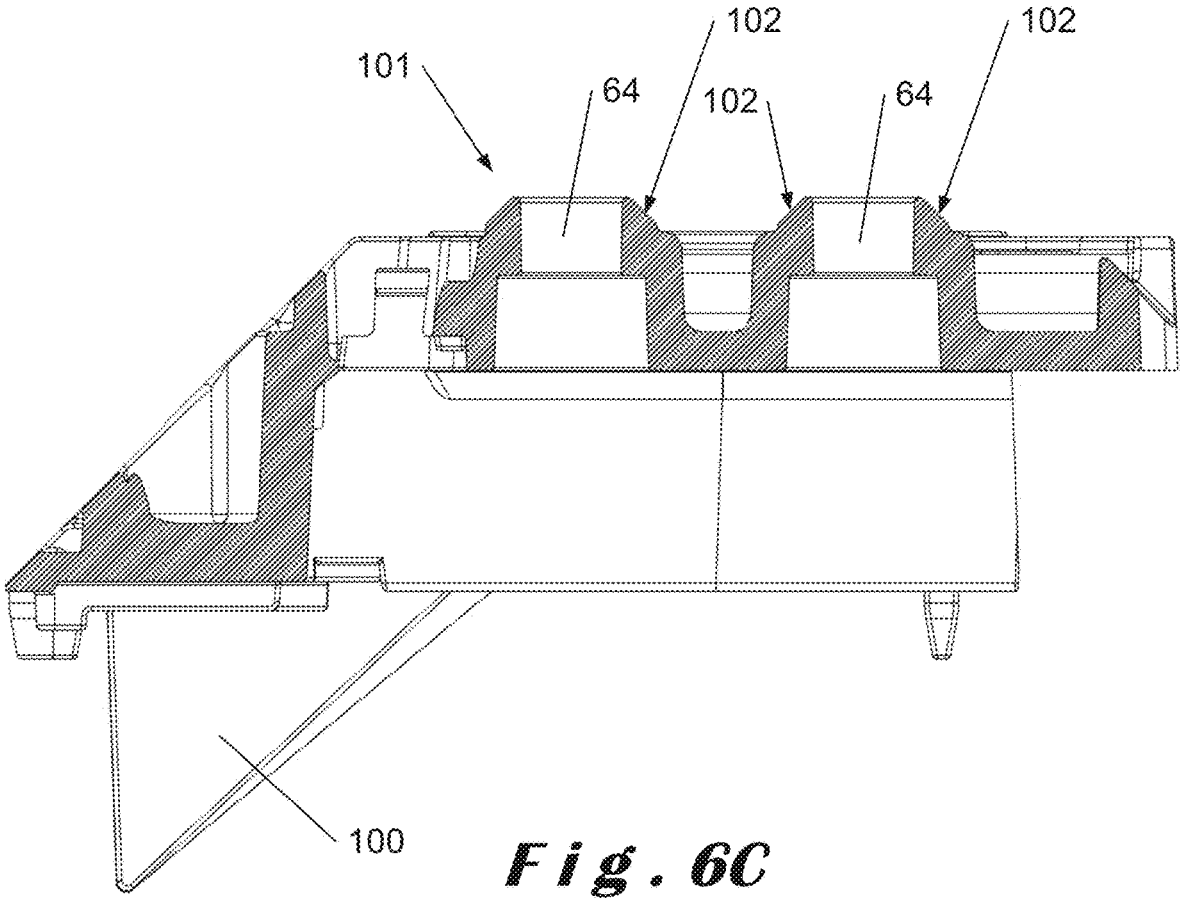
FIG. 6C shows a horizontal section through the headboard of FIG. 5.

The headboard 60 for use with the beams 3, 5 is shown in more detail in FIGS. 6A to 6C. FIG. 6A shows the rear of the headboard 60, i.e. the side facing away from the beams after attachment. FIG. 6B shows the front side of the headboard 60, i.e. the side facing the beams after attachment. FIG. 6C shows a horizontal cross-section through the headboard 60.

Six openings 62 are provided in the headboard, which positioning correspond to the screw channels 115, 116, 117, 208, 219, 220. This allows to secure the headboard 60 to beams 3, 5 by means of six screws or bolts 61, protruding through openings 62. It will be readily appreciated that more or less openings and screw channels can be used, if desired. Although it is also possible to provide the screw channels in the headboard and to screw the bolts from the beams onto the headboard, the embodiment shown is preferred. This is because the headboard can be made more compact, in particular thinner, if no long screw channels are to be present.

As shown in FIG. 6A, the headboard 60 is provided at its rear with four openings 64 and one or more hooks 65. These form each an alternative way of attaching the headboard 60 to the column 2, as described in more detail hereafter.

At the bottom side, the headboard 60 is provided with a spout-shaped part 63, which connects to the central gutter 27 of the beams 3, 5. In this way, precipitation collected in the internal gutter 27 can leave it via spout 63. The external gutter 28 is provided with a closure (not shown) at its front end, such that the precipitation collected in the external gutter 28 cannot but flow to the internal gutter 27. A recess (not shown) can also be provided on the lower wall of the headboard 60, in which a tensioning piece (not shown) can be placed for reinforcing the connection to the support pillar 70.

FIG. 6B also illustrates the provision of a number of holders to the front side of the headboard. In particular, there is an electronics holder 68 in which the necessary electronics can be placed, for example for driving the screen 6. Along the electronics holder 68 a screen holder 69 is present in which one end of the screen roll can be placed. A prism-shaped abutment 100 is also provided, which aids in the alignment of the headboard 60 with the beam 3. In particular, the abutment 100 fits into the cavity 27.

FIG. 6C shows that the headboard 60 is provided at its rear side with two projection ribs 101 extending in the vertical direction. Each projection rib 101 has two inclined walls 102 and bolt openings 64 are provided centrally therein. As further described, each projection rib 101 forms a tongue which cooperates with a groove on the corner element 43 and provides mutual alignment when connecting the headboard 60 to the corner element 43.

Figure 7:
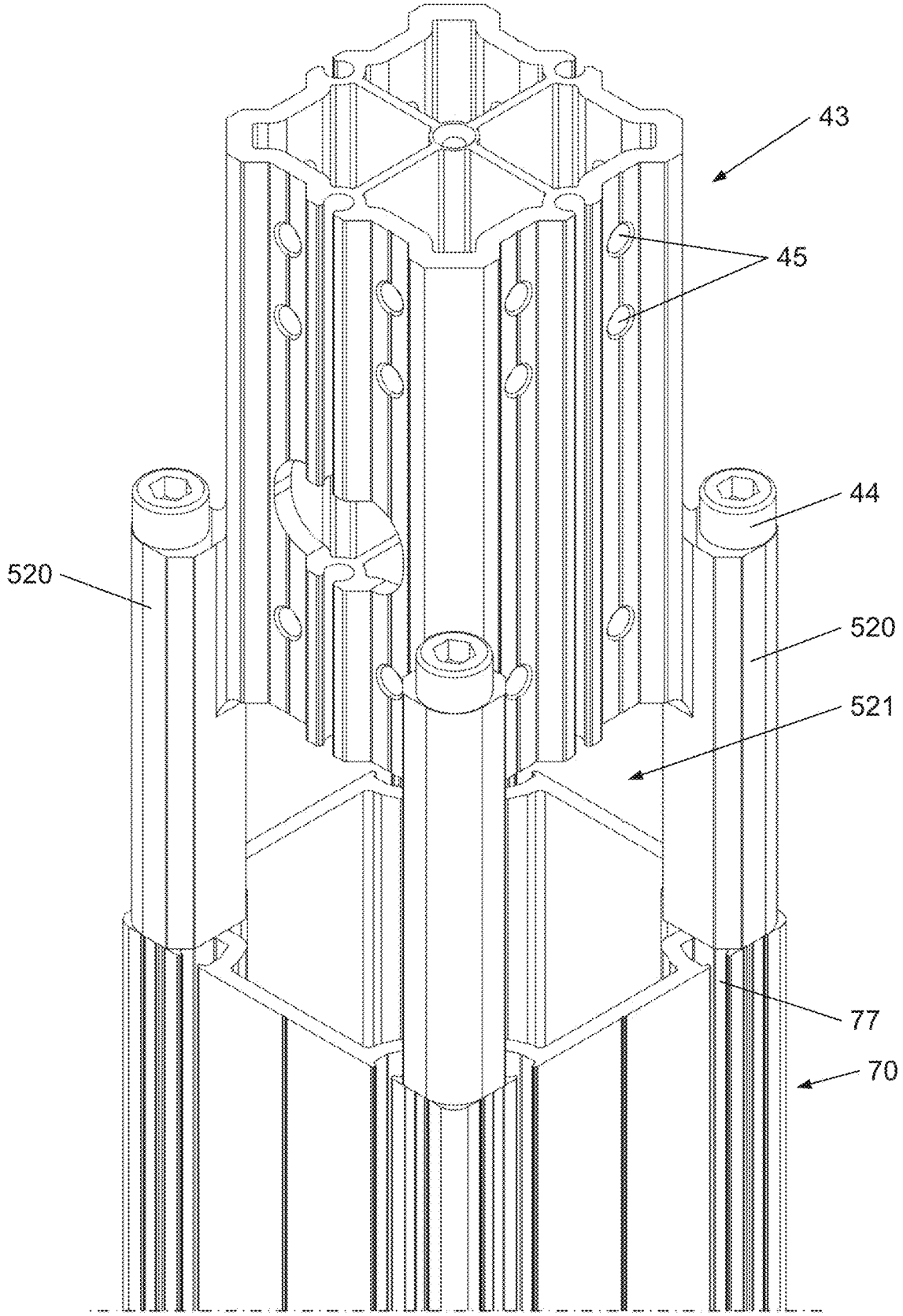
FIG. 7 shows a perspective view of the column of the terrace canopy of FIG. 2.
Figure 8A:
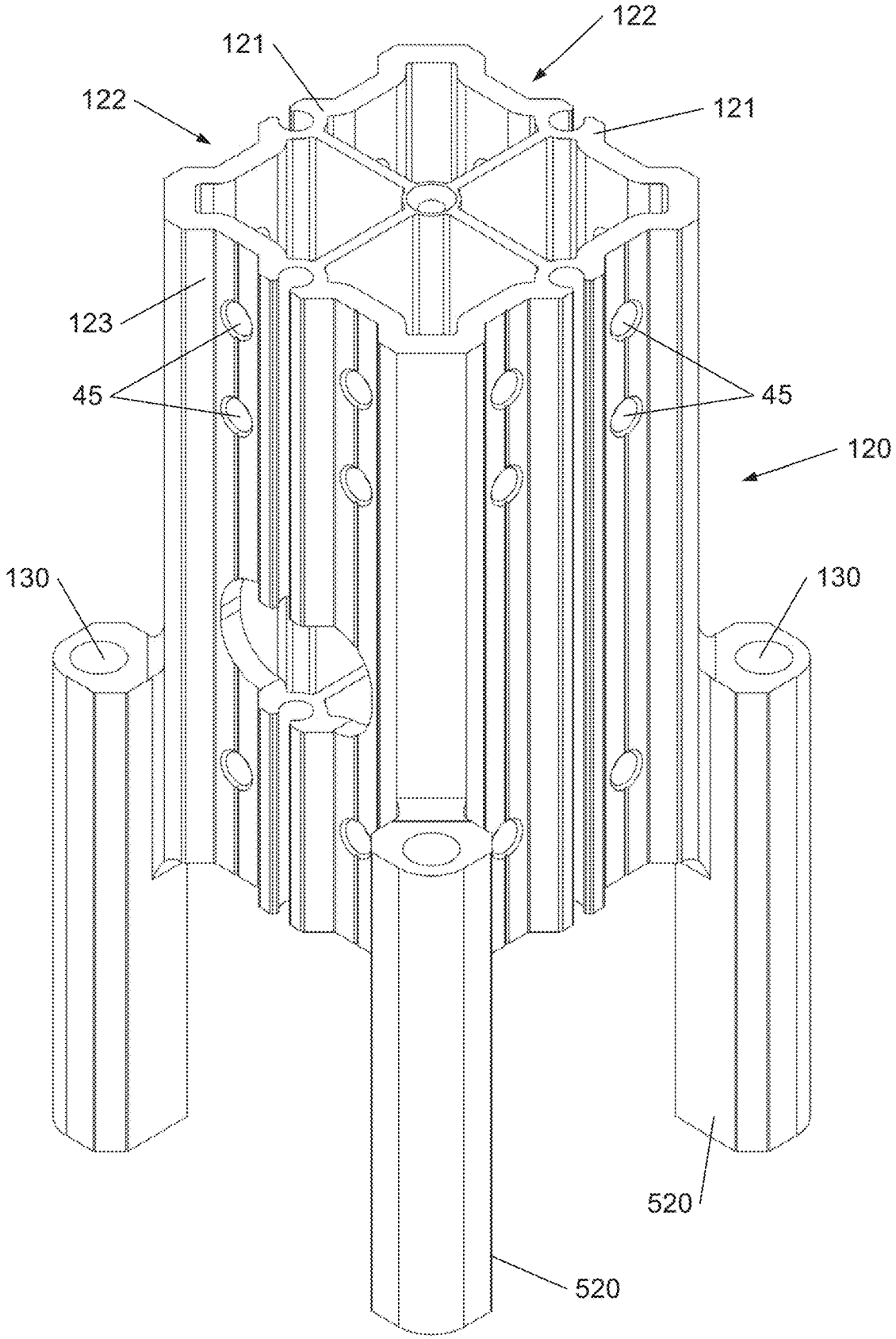
FIG. 8A shows a perspective view of the corner element of the column of FIG. 7.
Figure 8B:
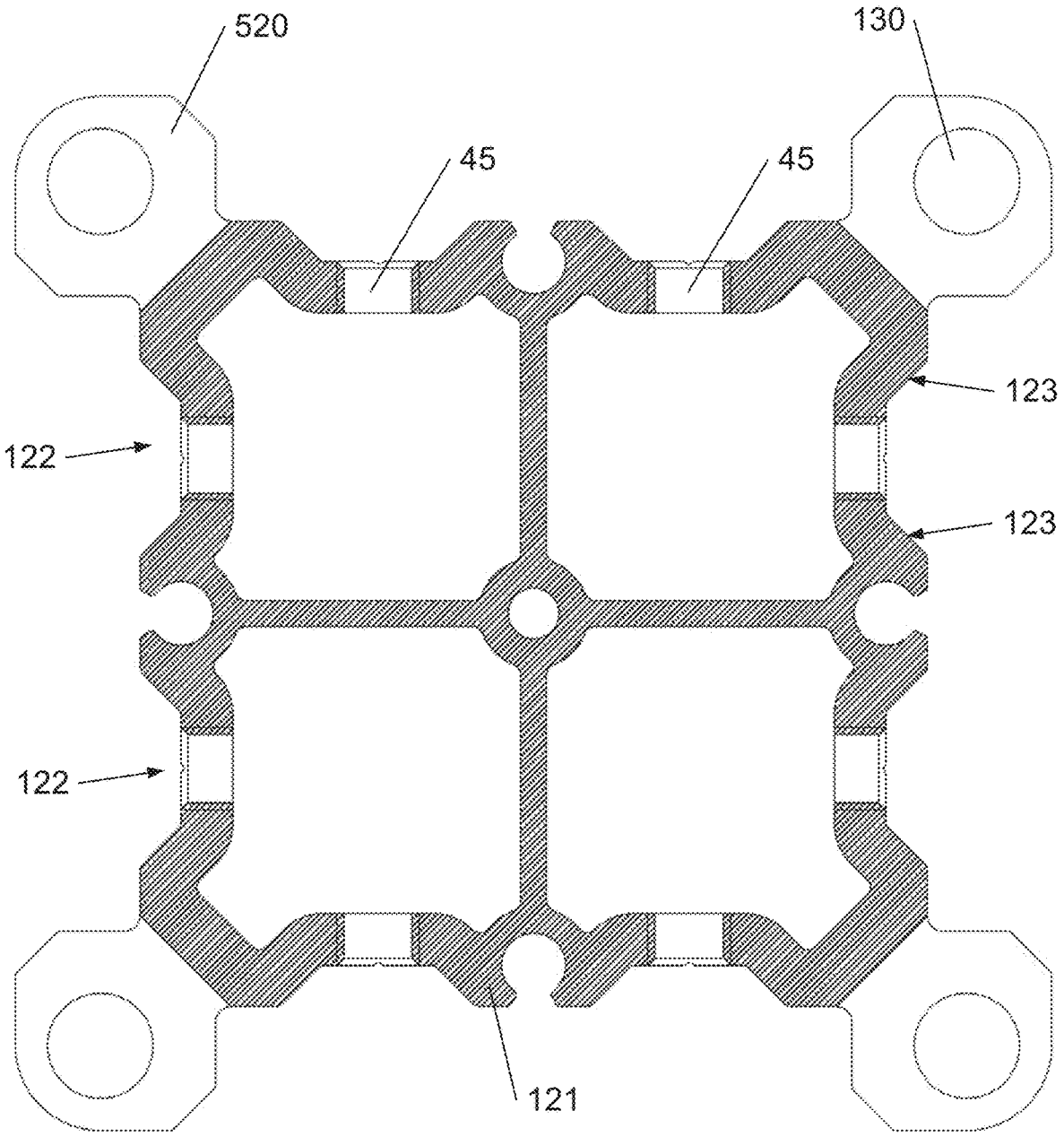
FIG. 8B shows a horizontal section through the corner element of FIG. 8A.
Figure 9:
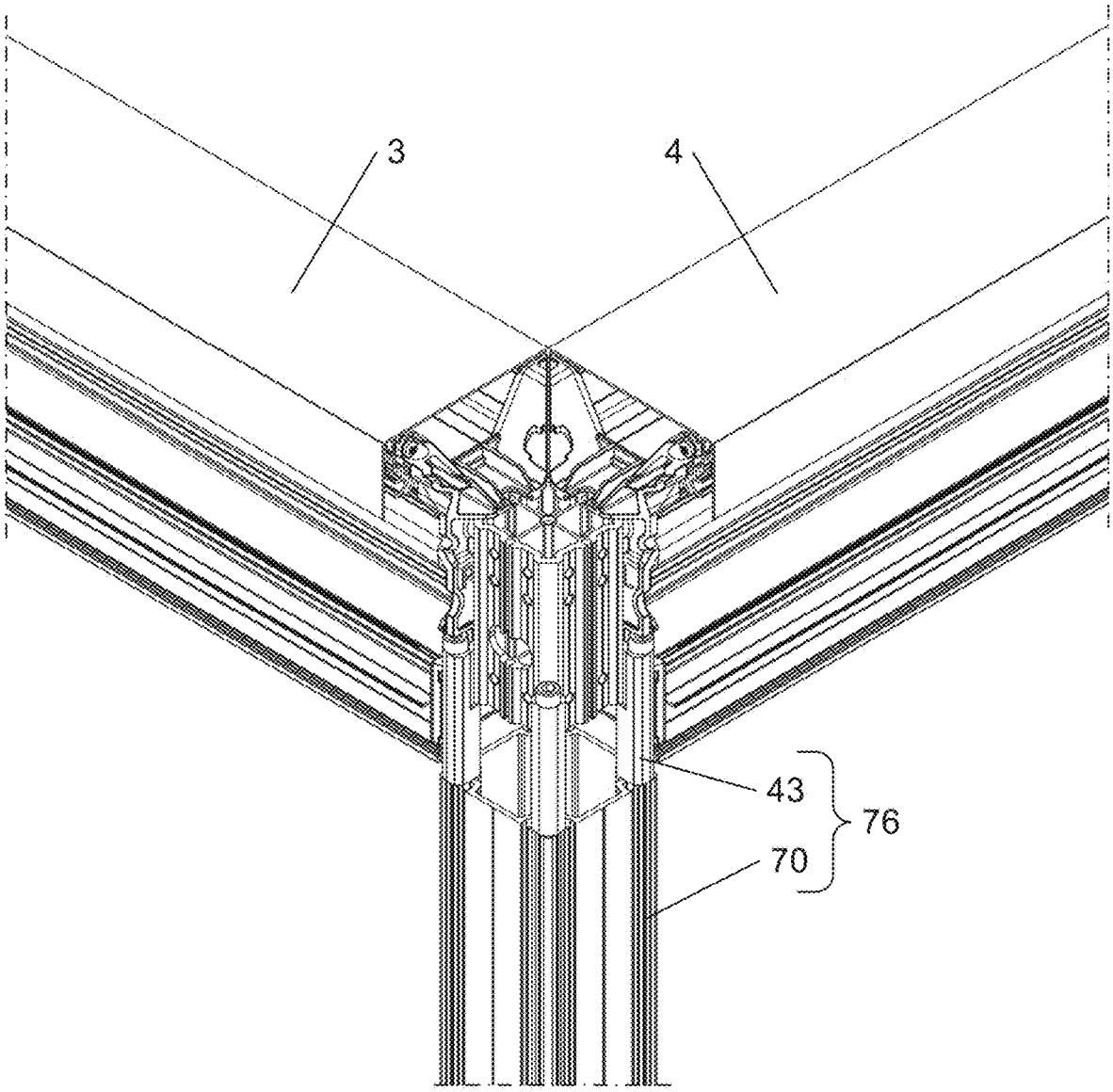
FIG. 9 shows a perspective view of the corner connection of two beams with a supporting column.
Figure 10:
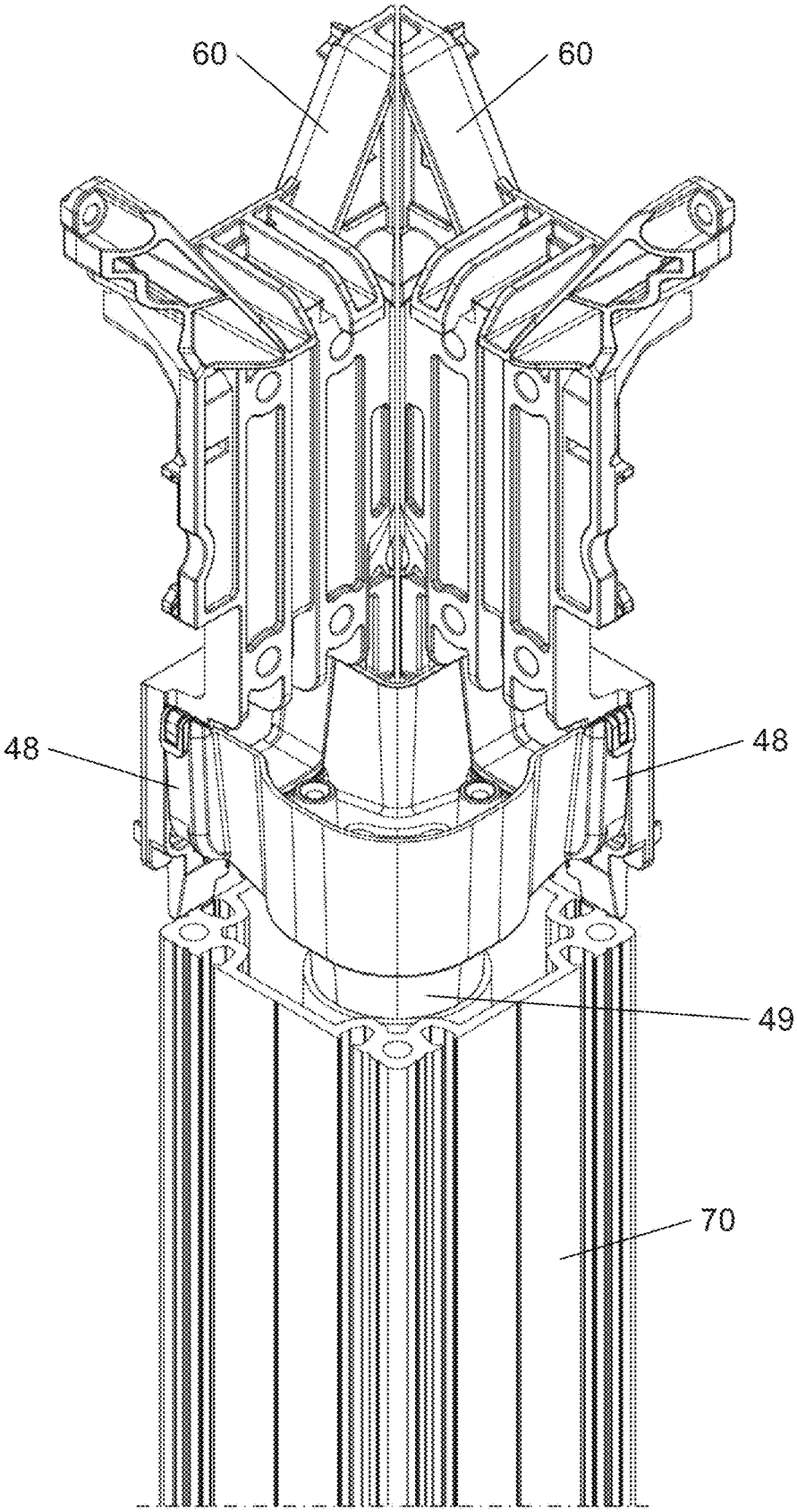
FIG. 10 shows the same perspective view as FIG. 9 in which the beams have been removed and where a water drainage has been added.

FIG. 7 illustrates the core profile 70 serving as a support pillar to which a corner element 43 is secured. The corner element 43 is shown separately in FIGS. 8A and 8B. In particular, the core profile 70 is provided on its top side with four openings 74 (see FIG. 4) suitable for receiving bolts or screws 44. Correspondingly, the corner element 43 is provided with four legs 520, in particular one leg 520 per corner of the corner element 43. Between the legs 520, openings are provided which serve as passage 521 for precipitation drainage. In particular, as further described, the spout portion 63 of a headboard 60 and/or an end 48 of the water drain 46 fits into the passage 521. The legs 520 are hollow (i.e. an opening 130 extends through each leg 520) such that the bolts 44 can be screwed through the legs 520 onto the profile 70 to allow the crown 71 to be attached directly to the profile 70, as shown in FIG. 10. By this attachment, the profile 70 and the corner element 43 together form the core 76 of the column 2, as indicated in FIG. 9. It is this core 76 that serves as a constructive element, in particular as a support for the beams 3, 5. It is also possible to manufacture the corner element 43 integrally with the support pillar 70.

It will be readily appreciated that other connection means are also possible to secure the legs 520 to the top sire or the outside of the support pillar 70, such as the use of an elongate rod and securing it by one or more transverse pins or by welding the parts together. A threaded rod can also be used as a connection means, in which case it is, for example, fixedly provided on the top of the profile 70 and over which the legs 520 are slid.

The corner element 43 serves for attaching the beams 3, 5 to the column 2. The corner element 43 is provided with a beam-shaped upper part 120, the support legs 520 of which extend downwards. The beam-shaped part 120 comprises four wall portions 121 against which a headboard 60 of a beam 3 can be attached. Each wall portion 121 is provided with a groove 122 with oblique walls 123. At the bottom of the groove 122 there are bolt openings 45 into which the bolts are screwed to secure the headboard 60 to the corner element 43. Alternatively (or additionally), the top side of the corner element 43 can be used to place the hooks 65 on it for fastening the headboard 60 to the top side of the corner element 43. The hooks 65 are easy to use and can be used, for example, during installation to firstly hook the beams 3, 5, and then, without having to support them, to secure them with the bolts 66. The attachment with bolts 66 is sturdier and is preferred. In practice, both connections are used simultaneously. In this way, the headboards 60 together with the corner element 43 actually form a corner connection between the beams 3, 5 and the support pillar 70.

The main advantage of the structure of column 2 is that the forces by the beams 3, 4, 5, for example due to their weight or due to wind load on a side wall that is attached to the beams 3, 4, 5, are transferred directly to the core 76, in particular to the corner element 43 thereof. In other words, although the headboards 60 are located between the beams 3, 4, 5 and the corner element 43, they no longer serve as a supporting element to directly transfer the forces to the support pillar 70, unlike the terrace canopy described in BE 2014/0015.

As already described above, the rear side of the headboard 60 is provided with projection ribs 101. These are intended to fit into the grooves 122 provided on the wall portions 121 of the corner element 43. The projection ribs 101 and the grooves 122 form mutually cooperating alignment means for the purpose of the correct positioning of the headboard 60 on the corner element 43. It is, in fact, the case that the bolt openings 64 in the headboard 60 have been made too large for the corresponding bolt, in order to compensate for tolerances in the manufacture of the corner element 43 and the headboard 60. In particular, the bolt openings 45 are drilled and/or milled in the corner element 43 such that there is a manufacturing tolerance at these bolt openings 45, in particular the exact location of each bolt opening 45 may vary with respect to the ideal position (a so-called positional tolerance). The bolt openings 64 in the headboard 60 are therefore deliberately manufactured too large to accommodate the positional tolerance of the bolt openings 45.

The drawback of this is that the headboard 60 can shift laterally with respect to the corner element 43. A further drawback is also that the headboard 60 can tilt (i.e. rotate with respect to the vertical direction) with respect to the corner element 43. The mutually cooperating alignment means 101, 122 prevent, or at least reduce, such undesired displacements of the headboard 60 with respect to the corner element 43.

As already described, it is advantageous to provide the bolt openings 64 between the inclined walls 102 of the tooth 101 to reduce stresses in the headboard 60. It is also advantageous that the tongue and groove 101, 122 are provided with slanting walls 102, 123 for easy installation in comparison with perpendicularly oriented walls. It is further advantageous to provide the groove 122 on the corner element 43 in order to avoid that the headboard 60 has to be designed larger. It is of course also possible to work with only one tongue and groove per headboard 60 instead of the two tongues and grooves shown.

The design of the tongue and groove 101, 122 is very advantageous in combination with the preferred production method of the components 60, 43 and the mounting method of the terrace canopy 1. During mounting, the beam 3, 4 with the headboards 60 on it, is slid from the top side between two already placed columns 2 until the hooks 65 hook onto the top edge of the corner element 43. Subsequently, bolts 522 are inserted through the opened screen cavity 25 (i.e. when the front cover 14 is removed) to secure the headboard 60 to the corresponding wall portion 121 of the corner element 43. Alternatively, these bolts 522 can be inserted internally from the top side into the corner element 43 so as to place them in the bolt openings 45, 64 to secure the headboard 60 to the corresponding wall portion 121 of the corner element 43.

Figure 11:
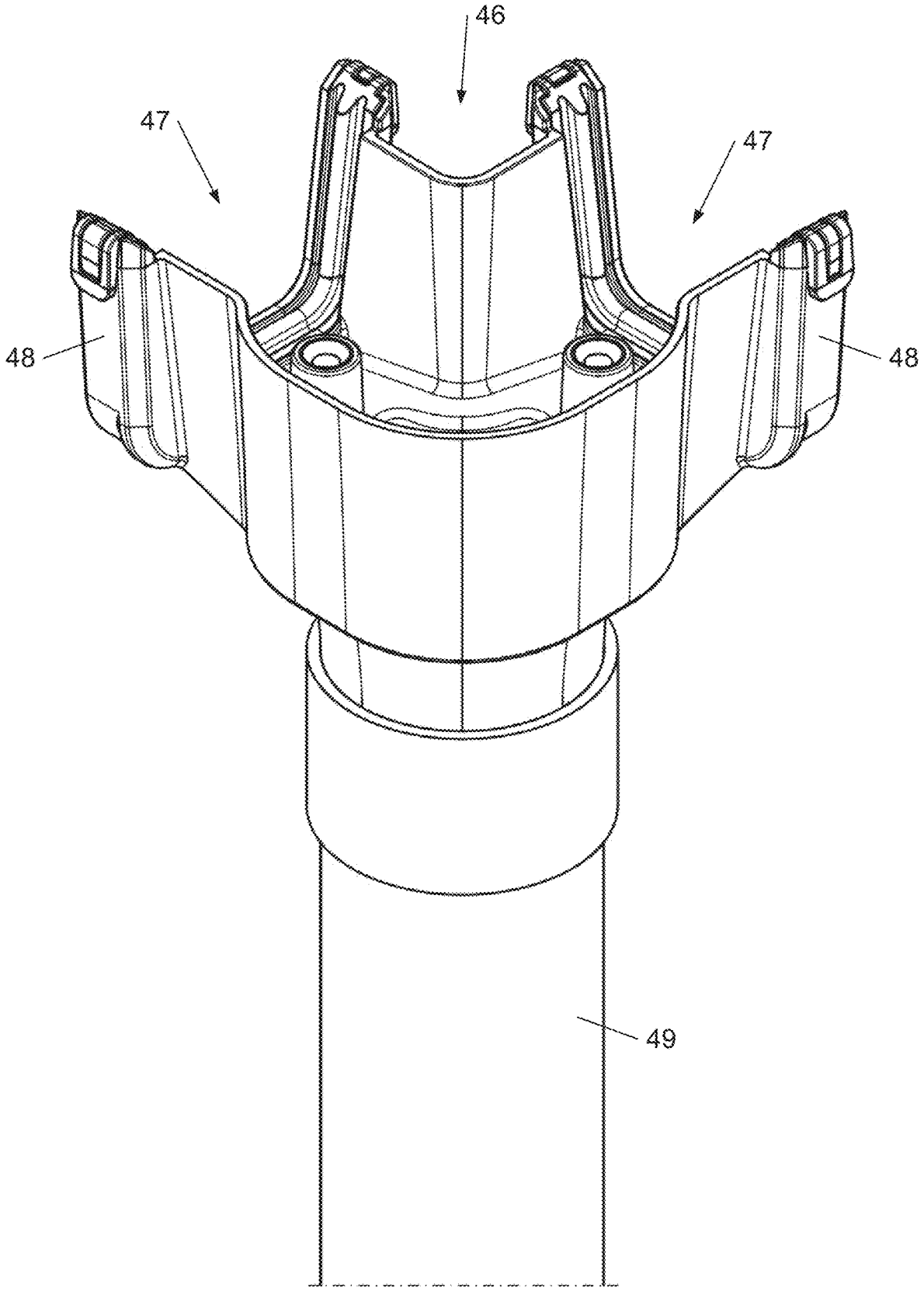
FIG. 11 shows a perspective view of the water drainage of FIG. 10.

FIGS. 10 and 11 illustrate the precipitation discharge from the beams 3, 4, 5 to the column 2. The core profile 70 is of a hollow design (see FIG. 4), which allows to provide a drain 46 for precipitation. This cavity 75 can also be used to integrate electrical lines. Although the cavity 85 between profile 70 and the finishing profiles 78 is preferably used for this purpose, since these are more easily accessible after mounting.

The drain 46 shown is designed as a collection basin which comprises at the top side two insertion cavities 47, formed by ends 48 (see FIG. 11). The spout 63 of a headboard 60 is inserted into a corresponding insertion cavity 47. The drain 46 shown is provided for coupling two beams 3, 4 at an angle which is supported by a column 2. A downpipe 49 is provided centrally in the drain 46 such that the supplied precipitation can be diverted to the bottom of the column 2 where it can exit the column 2 through an opening (not shown).

In view of the multitude of possible corner connections between the beams 3, 4, 5 of the terrace canopy (see FIG. 1), a multitude of different drains 46 are possible. This can range from a simple corner drain, as shown in FIGS. 10 and 11, to a central drain onto which four beams open out, to a passage from one beam to the other in which no downpipe 49 is present. Optionally, the downpipe 49 can also be omitted such that precipitation flows through the cavity 75 of the core profile 70.

In an embodiment, the terrace canopy 1 is mounted by performing the following steps. In a first phase, the headboards 60 are attached to the beams 3, 5. In particular on the base profile 12 and the gutter profile 13. In this phase, the corner element 43 is also placed on the support pillar 70 such that the core 76 of the column is formed. Thereafter, the headboards 60 (with a part of the beams 3, 5 already thereon) are hooked, via hooks 65, to the core 76, in particular to the corner element 43. Since the front cover 14 has not yet been placed on the beam 3, 5, it is now possible to place bolts through openings 64 in the headboard 60 for screwing it to the corner element 43 through openings 45 therein. In the next phase, the screen roller can be placed in the beams 3, 5 and/or another type of wall infill and/or other internal components such as the roof covering 7, etc. After all internal components have been installed, the front cover 14 and/or the cover profile 15 and/or the closing profile 19 are positioned for finishing the beam.

While certain aspects of the present invention have been described with respect to specific embodiments, it is to be understood that these aspects may be implemented in other forms within the scope of protection as defined by the claims.

The invention claimed is:

1. A terrace canopy comprising:

a support pillar extending in a substantially vertical direction;

a first and a second beam each extending in a substantially horizontal direction, wherein each beam is provided with a headboard at least one end; and a corner element positioned between and secured to the support pillar and the beams and provided with a first and a second wall portion, wherein the headboard of the first beam is attached against the first wall portion of the corner element, and wherein the headboard of the second beam is attached against the second wall portion of the corner element, wherein mutually cooperating alignment means are provided between each wall portion and the headboard attached thereto, the mutually cooperating alignment means being configured for aligning each beam with respect to the support pillar, wherein the mutually cooperating alignment means comprise a tongue and groove, wherein the groove opens outward from each wall portion in the substantially horizontal direction.

2. The terrace canopy according to claim 1, wherein each beam comprises a height direction and wherein the mutually cooperating alignment means are configured for aligning the height direction of each beam with respect to the substantially vertical direction.

3. The terrace canopy according to claim 1, wherein each beam comprises a width direction and wherein the mutually cooperating alignment means are configured to align each beam in the width direction with respect to the support pillar.

4. The terrace canopy according to claim 1, wherein the tongue and the groove have mutual contact surfaces oriented obliquely with respect to the corresponding wall portion.

5. The terrace canopy according to claim 1, wherein the groove is provided in the first and the second wall portions of the corner element and wherein the tongue is provided on each headboard.

6. The terrace canopy according to claim 1, wherein the corner element has a rotational symmetry of order four or higher.

7. The terrace canopy according to claim 1, wherein the terrace canopy further comprises a third beam and a fourth beam, wherein the corner element further comprises a third and a fourth wall portion, wherein a headboard of the third beam is attached against the third wall portion of the corner element, and wherein a headboard of the fourth beam is attached against the fourth wall portion of the corner element.

8. The terrace canopy according to claim 1, wherein each headboard is provided with at least one bolt opening and wherein the corner element is provided with a corresponding bolt opening in each wall portion for attaching each headboard to the corner element.

9. The terrace canopy according to claim 8, wherein one of the at least one bolt opening and the corresponding bolt opening is provided on a bottom of the groove.

10. The terrace canopy according to claim 1, wherein the corner element is integrally formed, wherein each headboard is integrally formed.

11. The terrace canopy according to claim 1, wherein each headboard is provided with at least one hook configured to hook onto an upper end of each wall portion of the corner element for attaching each headboard to the corner element.

12. The terrace canopy according to claim 1, wherein at least one of the beams is provided with a gutter for discharging precipitation incident on the terrace canopy to a front end of the at least one of the beams and wherein the support pillar is provided with a cavity for discharging precipitation incident on the terrace canopy towards a ground surface.

13. The terrace canopy according to claim 12, wherein the corner element is provided with at least one passage connecting the gutter with the cavity of the support pillar.

14. The terrace canopy according to claim 13, wherein the at least one passage is located below the first and the second wall portions in the substantially vertical direction.

15. The terrace canopy according to claim 1, wherein the corner element is provided with one or a plurality of support legs extending in the substantially vertical direction of the support pillar.

16. The terrace canopy according to claim 1, wherein the mutually cooperating alignment means are configured for mutually aligning a vertical axis of each beam with respect to a vertical axis of the support pillar or for mutually aligning a bottom surface of each beam with respect to an upper surface of the support pillar or for mutually aligning a side surface of each beam with respect to a side face of the support pillar.

17. A terrace canopy comprising:

a support pillar extending in a substantially vertical direction;

a first and a second beam each extending in a substantially horizontal direction, wherein each beam is provided with a headboard at least one end; and a corner element positioned between and secured to the support pillar and the beams and provided with a first and a second wall portion, wherein the headboard of the first beam is attached against the first wall portion of the corner element, and wherein the headboard of the second beam is attached against the second wall portion of the corner element, wherein mutually cooperating alignment means are provided between each wall portion and the headboard attached thereto, the mutually cooperating alignment means being configured for aligning each beam with respect to the support pillar, wherein the mutually cooperating alignment means comprise a tongue and groove, wherein the tongue and the groove extend in the substantially vertical direction.

* * * * *